United States Patent [19]

Yamamoto et al.

[11] Patent Number: 4,482,396

[45] Date of Patent: Nov. 13, 1984

[54] METHOD FOR MAKING PITTING RESISTANT CAST IRON PRODUCT

[75] Inventors: Yukio Yamamoto; Masashi Yoritaka, both of Hiroshima, Japan

[73] Assignee: Mazda Motor Corporation, Hiroshima, Japan

[21] Appl. No.: 526,531

[22] Filed: Aug. 25, 1983

[30] Foreign Application Priority Data

Aug. 26, 1982 [JP] Japan ..... 57-148059

[51] Int. Cl.[3] ..... C21D 5/00

[52] U.S. Cl. ..... 148/3; 148/141; 148/35; 148/39; 75/128 C; 75/128 D; 75/128 W

[58] Field of Search ..... 148/138, 141, 3, 35, 148/39; 75/128 C, 128 D, 128 W

[56] References Cited

U.S. PATENT DOCUMENTS 2,962,397 11/1960 Thompson ..... 148/141
4,032,334 6/1977 Burk et al. ..... 75/128 C
4,124,413 11/1978 Komatsu et al. ..... 148/3

FOREIGN PATENT DOCUMENTS 43-17497 7/1968 Japan .

OTHER PUBLICATIONS

Marbaker E., "Heat Treatment of Gray Cast Iron", Iron Age, Aug. 2, 1928.

*Primary Examiner*—L. Dewayne Rutledge
*Assistant Examiner*—Christopher W. Brody
*Attorney, Agent, or Firm*—Burns, Doane, Swecker and Mathis

[57] ABSTRACT

A method for making a cast iron product having a high resistance to both wear and pitting. The method comprises casting a cast iron containing C, Si, Mn, Cu, Ni, Cr and Mo with or without P and S to provide a casting having a local chilled structure having a cementite content of 30 to 50%. The casting is then annealed at a reduced temperature and subsequently subjected to a quenching treatment. The quenching treatment is carried out by heating the casting under a particular condition including heating temperature and time and then quenching it. The product is finally tempered.

1 Claim, 3 Drawing Figures

METHOD FOR MAKING PITTING RESISTANT CAST IRON PRODUCT

BACKGROUND OF THE INVENTION

This invention relates to a method for the manufacture of a cast iron product having a high resistance to pitting.

A cast iron product such as, for example, a tappet or valve lifter generally used in an automobile engine system, is generally required to have both a resistance to wear and a resistance to pitting because it is frequently subjected to repeated friction and repeated impact. The Japanese Patent Publication No. 43-17497, published July 24, 1968, discloses the production of a wear resistant tappet made of cast iron.

According to the above mentioned publication, a cast iron containing 2.7 to 3.8% of carbon (C), 1.7 to 3.0% of silicon (Si), 0.5 to 1.5% of manganese (Mn), up to 1.5% of nickel (Ni), 0.2 to 1.0% of chromium (Cr), up to 1.0% of molybdenum (Mo), 0.01 to 0.10% of boron (B) and iron (Fe) being the balance, wherein the ratio of addition of B and Cr is within the range of 1:1 to 1:10, is first melted in an electric furnace. The melt is then cast into a mold using a chiller for chilling that portion of the casting which eventually defines an abutment face of the valve lifter for the engagement with a cam lobe so that a chilled structure can be imparted to the abutment face of the valve lifter while the remaining portion thereof represents a structure of gray cast iron. Thereafter, in order for graphite to be precipitated at the eventually defined abutment face of the valve lifter, the casting is annealed for 10 to 120 minutes at a temperature within the range of 850° to 950° C. Subsequent to the annealing, the annealed casting is machined leaving a finishing allowance, followed by the heating for 5 to 20 minutes at a temperature within the range of 800° to 900° C. for the subsequent quenching into oil. Finally, the quenched casting is tempered at 100° to 250° C. for not more than 120 minutes to render the abutment face to exhibit a martensite matrix containing carbide and annealed graphite dispersed therein.

It appears that the self-lubricating property and the improved resistance to wear of the cast iron product manufactured by the prior art method discussed above have resulted from the presence of the graphite which has been precipitated by annealing at a high temperature the carbide ($Fe_3C$), that is, the cementite structure, formed by the use of the chiller. While it has been found, as hereinafter discussed in connection with the present invention, that an excellent resistance to wear can be obtained if the amount of the cementite remaining in the base material is relatively great, the reduced amount of the cementite has been found resulting in the reduced resistance to pitting.

Moreover, according to the prior art method discussed above, the cast iron product subsequent to the machining step is subjected to the quenching treatment consisting of heating at 800° to 900° C. for 5 to 20 minutes and rapidly cooling in oil. Because of this quenching treatment, it has been found that not only is the matrix transformed to a martensite structure, but also a ferrite layer is formed as an intermediate layer. Since the ferrite layer is fragile and brittle, the presence of the ferrite layer constitutes a cause of "tapping wear" in which particles of the carbide drop from the base material and a cause of the reduced resistance to pitting. Therefore, the prior art method discussed above employs the addition of boron for the purpose of minimizing the formation of the ferrite layer.

Apart from the above discussed prior art method, U.S. Pat. No. 4,124,413, patented Nov. 7, 1978, discloses a method of producing a wear and pitting resistant cast iron, which method comprises casting a melt consisting essentially of 2.8 to 3.3% of C, 1.5 to 2.1% of Si, 1.0 to 1.5% of Cr, 0.6 to 0.8% of Mo, 0.2 to 0.55% of Ni, up to 0.05% of P and the balance being substantially all iron, to form a casting having a free cementite content of 20 to 40% by volume, and then hardening the resultant casting by heating it at 860° to 950° for 1 to 10 hours and then quenching it to produce a product having a Vickers hardness of Hv 750 to 900.

The quenching or hardening treatment employed in the last mentioned prior art method is also susceptible to the formation of the ferrite layer, and nowhere in the patent specification is disclosed an idea of and countermeasures for suppressing the formation of the ferrite layer.

SUMMARY OF THE INVENTION

Accordingly, this invention has been developed with a view to substantially eliminating the disadvantages inherent in the prior art methods and has for its essential object to provide an improved method wherein the decomposition of the cementite is advantageously minimized.

Another important object of this invention is to provide an improved method of the type referred to above, wherein the quenching treatment is carried out by the use of a salt bath at a specific temperature for a specific time to minimize the formation of the intermediate layer with no boron used.

A further important object of this invention is to provide an improved method of the type referred to above, which is effective and efficient to produce a cast iron product having the excellent resistance to both wear and pitting.

These object of this invention can be accomplished by using, as a starting material, a cast iron of a composition containing 2.8 to 3.8% of C, 1.8 to 2.8% of Si, 0.5 to 1.0% of Mn, 0.2 to 1.0% of Cu, 0.2 to 1.0% of Ni, 0.5 to 1.5% of Cr, 0.4 to 1.5% of Mo, up to 0.15% of P, up to 0.1% of S and Fe being the balance. The cast iron of the specific composition is melted and then cast to form a casting having a portion, which may eventually be used as a sliding face, representing a chilled structure having a cementite content of 30 to 50%. The resulting casting is then annealed at 550° to 630° C. for 20 to 60 minutes and is subsequently machined.

Thereafter, the machined casting is loaded in a salt bath to heat it under the condition wherein the heating temperature and the heating time fall within the area surrounded by the points A, B, C, D, E, F and G depicted in the graph of FIG. 1 of the accompanying drawings; A representing the heating conditions of 950° C. and 1 minute, B representing that of 910° C. and 1 minute, C representing that of 870° C. and 2 minutes, D representing that of 850° C. and 4 minutes, E representing that of 850° C. and 10 minutes, F representing that of 870° C. and 10 minutes, and G representing that of 950° C. and 6 minutes. The heated casting is then quenched to render the matrix to be transformed into a martensite without decomposing the cementite and is finally tempered at 100° to 250° C. for a predetermined time not longer than 120 minutes.

BRIEF DESCRIPTION OF THE DRAWINGS

These and other objects and features of this invention will become clear from the following detailed description taken in connection with a preferred embodiment thereof with reference to the accompanying drawings, in which.

DETAILED DESCRIPTION OF THE EMBODIMENT

Figure 1:
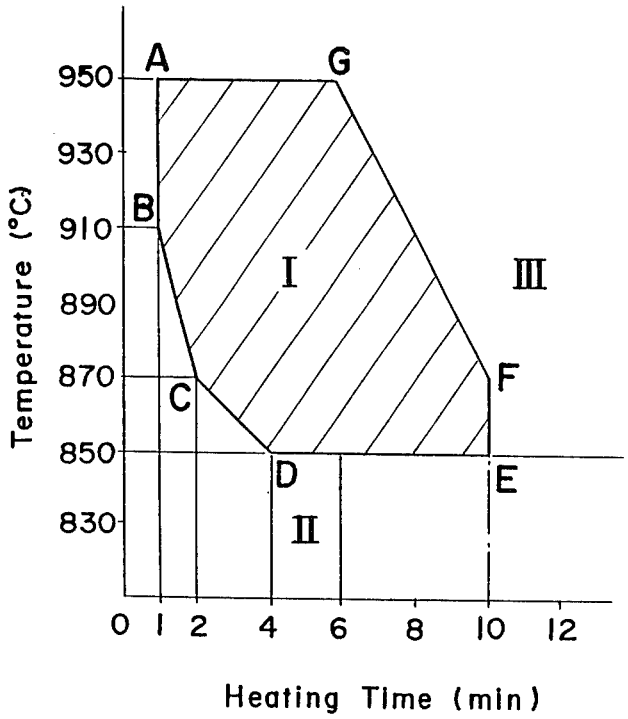
FIG. 1 is a graph showing a heating condition to be employed during the quenching treatment according to this invention.

As hereinbefore described, as a starting material to be used in the practice of the method of this invention, a cast iron of the following composition is employed:

C: 2.8 to 3.8%
Si: 1.8 to 2.8%
Mn: 0.5 to 1.0%
Cu: 0.2 to 1.0%
Ni: 0.2 to 1.0%
Cr: 0.5 to 1.5%
Mo: 0.4 to 1.5%
P: up to 0.15%
S: up to 0.1%
Fe: the balance Preferably, the use of a cast iron containing 3.47% of C, 2.34% of Si, 0.83% of Mn, 0.25% of Cu, 0.38% of Ni, 1.12% of Cr. 0.48% of Mo, 0.135% of P and Fe being the balance is desirable as the starting material.

The range of amount of each of the elements forming the composition of the starting material is defined by the following respective reason.

C: 2.8 to 3.8% is necessary in the light of the amount of carbide to be formed.

Si: This element serves to improve the castability and to control both the amount of graphite and the depth of a chilled structure. 1.8 to 2.8% is necessary in view of the amount of C employed.

Mn: The lowermost limit must be 0.5%, or the silicon contained in the cast iron will not be transformed into MnS. On the other hand, if the amount exceeds the uppermost limit of 1.0%, the cast iron will shrink considerably.

Cu: This element serves to strengthen the matrix and also to improve the quenching property. This will not be achieved, if the amount is smaller than the lowermost limit of 0.2%, and will be saturated if it is more than the uppermost limit of 1.0%.

Ni: A reasoning similar to that of Cu applies.

Cr: This element serves to stabilize the carbide and also to improve the wear resistance. If the amount employed exceeds the uppermost limit of 0.5%, the machinability will be adversely affected.

Mo: This element serves to strengthen the matrix. This can not be achieved, if the amount is smaller than the lowermost limit of 0.4%, and will be saturated if it is more than the uppermost limit of 1.5%.

P and S: The uppermost limit of the amount of each of these elements is a maximum permissible amount that can be employed as impurity.

The cast iron of the above described composition is, in the first place, cast into a mold having a chiller fitted thereto at a location in register with that portion of the casting which may eventually be used as a sliding face, so that 30 to 50% cementite ($Fe_3C$) can be precipitated at that portion of the casting. It should be noted that, if the amount of the cementite precipitated is excessively great or small, the ultimate product will be brittle or low in wear resistance, respectively.

The casting so formed is then annealed at 550° to 630° C. for 20 to 60 minutes for the removal of stresses set up in the casting. The annealing temperature must be so low as to avoid the decomposition of the cementite and, hence, as to avoid the precipitation of graphite which would result from the decomposition of the cementite, leaving a relatively large amount of the cementite in the casting. This is in contrast to the prior art method of the first mentioned publication wherein the annealing temperature is described at 850° to 950° C.

The subsequent quenching treatment is carried out by loading the annealed casting in a salt bath to heat it under a specific condition of temperature and time, as will be described later, and then quenching it in oil. The specific heating condition to be employed during the quenching treatment in accordance with this invention must be such that the heating temperature and time fall within the area I surrounded by the points A,B,C,D,E,F and G depicted in the graph of FIG. 1; the point A representing the heating condition of 950° C. and 1 minute, the point B representing that of 910° C. and 1 minute, the point C representing that of 870° C. and 2 minutes, the point D representing that of 850° C. and 4 minutes, the point E representing that of 850° C. and 10 minutes, the point F representing that of 870° C. and 10 minutes, and the point G representing that of 950° C. and 6 minutes. It is to be noted that the heating time during the quenching treatment is counted from the time at which the outermost surface of the casting being heated has attained a temperature equal to the required heating temperature. This is because, depending on the capacity of the heating furnace, that is, the salt bath, the size of the casting and/or the number of the castings loaded in the heating furnace of a given capacity, the time varies for the outermost surface of the casting or castings to attain a temperature equal to the required heating temperature.

The quenching treatment performed in the manner hereinabove described is for the purpose of causing the matrix to be transformed to a martensite without the cementite being substantially decomposed. This can be accomplished by the use of the salt bath for the heating of the annealed casting because the salt bath is effective in that the surface layer (approximately 5 mm or less in thickness as measured inwardly from the outermost surface) of the casting can substantially uniformly be heated in a relatively short time and in that the quenched casting can have a uniform metallurgical structure. Where an atmospheric furnace is employed in place of the salt bath in the practice of the method of this invention, the control of the heating temperature and time will not be readily carried out with no difficulty and, also, a uniform matrix will not be obtained in the quenched casting.

Referring to FIG. 1, where the annealed casting is subjected to the quenching treatment under a condition falling within an area II outside the area I, since the heating temperature is relatively low and/or the heating time, is small, ferrite will remain around the cementite and, therefore, the resultant product will lack a sufficient resistance to pitting. On the other hand, where it is subjected to the quenching treatment under a condition falling within another area III outside the area I, since the heating temperature is relatively high and/or the heating time is large, the cementite will be decomposed so excessively as to result in the reduced resistance to wear.

After the quenching treatment, the casting is tempered at 100° to 250° C. for a predetermined time not longer than 120 minutes for stabilizing the martensite.

The cast iron product, i.e., a tappet follower for use in an automobile engine system, was prepared by the above described method of this invention and was tested as to it's resistance to both wear and pitting during a motoring engine test conducted under the following conditions:

| | |
|---|---|
| Engine Speed: | 2,000 rpm |
| Lubricant Oil: | 10W30 |
| Lubricant Temp.: | 80° C. |
| Spring Load: | 120 Kg |
| Counter-cam: | FCH/, chilled as cast |

The results of the tests on the pitting resistance are tabulated in the following table.

| Samples | Quenching Treatment | Time Elapsed Before the Occurrence of Pitting |
|---|---|---|
| (a) | Not Subjected | 50 hours |
| (b) | 850° C., 2 mins. | 70 hours |
| (c) | 870° C., 4 mins. | No Pitting Occurred* |
| (d) | 870° C., 12 mins. | No Pitting Occurred* |

*Even after 200 hours subsequent to the start of the tests.

It is to be noted that the time elapsed before the occurrence of pitting is defined as a time interval from the start of the test until the occurrence of pits of a macroscopic size of about 100 microns in the sliding face of the tappet follower.

Figure 2:
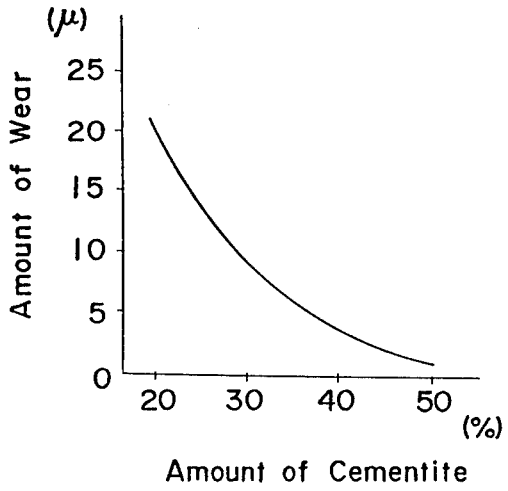
FIG. 2 is a graph showing the result of tests conducted to examine the resistance to wear.
Figure 3A:
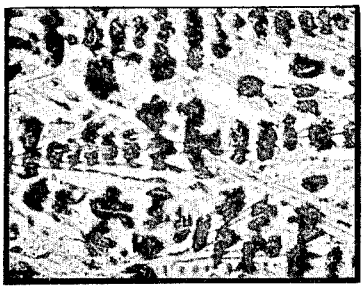
FIGS. 3(*a*) to 3(*d*) are photomicrographs of cast iron products showing metallurgical structure of sliding faces formed by the use of different quenching conditions, respectively.
Figure 3B:
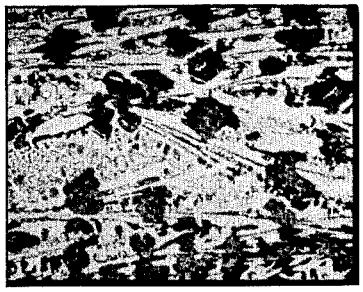
Figure 3C:
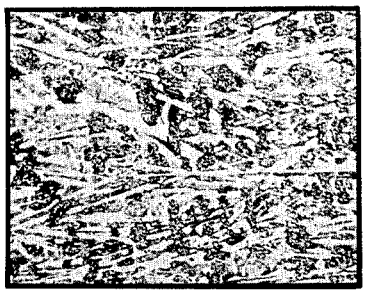
Figure 3D:
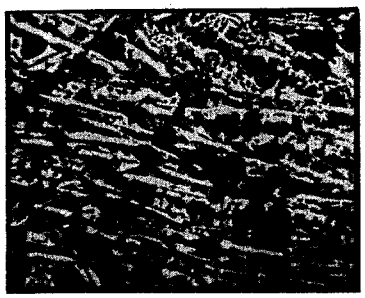

On the other hand, the results of the tests on the resistance to wear are plotted in a graph of FIG. 2. These tests were conducted under the same conditions as in the tests on the pitting resistance only to the tappet followers each having a respective sliding face exhibiting its metallurgical matrix completely transformed into the martensite. In the graph of FIG. 2, the axis of abscissas represents the amount of the martensite remaining in the respective sliding surface and the axis of ordinates represents the amount of wear in terms of the thickness of the respective sliding face worn out in 100 hours subsequent to the start of the test.

As can be readily understood from the graph of FIG. 2, the greater the amount of the cementite in the matrix, the smaller the amount of wear. However, when it comes to the tappet follower to be used in the automobile engine system, the amount of wear smaller than 10 microns is desirable and, therefore, it can be concluded that the amount of the cementite remaining in the matrix must not be smaller than 30%. However, if the amount of the remaining cementite exceeds 50%, the sliding face of the tappet follower will become fragile and brittle.

Photomicrographs of the respective cast iron products submitted to the tests on the pitting resistance are shown in FIGS. 3(*a*) to 3(*d*).

FIG. 3(*a*) pertains to the cast iron product which has not been subjected to the quenching treatment. In this photomicrograph, the dark area represents pearlite, the white background area represents cementite (40%) and the fringed white area represents ferrite. In view of the presence of the intermediate ferrite layer, the pitting resistance of the cast iron product is low.

FIG. 3(*b*) pertains to the cast iron product which has been quenched at 850° C. for 2 minutes, this quenching condition substantially falling within the area II shown in FIG. 1. In this photomicrograph, the dark area represents martensite transformed from the pearlite, the white background area represents cementite (40%), and the fringed white area represents ferrite. Because of the intermediate ferrite layer present in the matrix, the pitting resistance is still low.

FIG. 3(*c*) pertains to the cast iron product which has been quenched at 870° C. for 4 minutes, the quenching condition falling within the area I shown in FIG. 1. In this photomicrograph, the dark area represents martensite, and the white background area represents cementite (40%) with no ferrite appearing in the matrix. Therefore, the cast iron product of FIG. 3(*c*) has exhibited a high resistance to pitting.

FIG. 3(*d*) pertains to the cast iron product which has been quenched at 870° C. for 12 minutes, the quenching condition falling substantially within the area III shown in FIG. 1. In this photomicrograph, the dark area represents martensite, and the while background area represents cementite (25%). In this cast iron product, although no ferrite layer is formed, the cementite has been decomposed with the consequent increase of secondary graphite, and accordingly, the resistance to wear is low.

As hereinbefore fully described, the employment of both the relatively low annealing temperature and the combination of the salt bath with the peculiar quenching condition according to this invention is effective to avoid the decomposition of the cementite for the purpose of ultimately rendering the product to exhibit a high resistance to wear and also to avoid the formation of the intermediate ferrite layer for the purpose of ultimately rendering the product to exhibit a high resistance to pitting. Therefore, the cast iron product manufactured by the method of this invention has a high resistance to both wear and pitting. Accordingly, the cast iron product so manufactured can exhibit a high durability when used in a particular application where it is exposed to the high sliding pressure. By way of example, where the cast iron product is a tappet follower, it can be used under a condition with the increased spring load and, hence, the engine speed limit can be increased.

Although this invention has fully been described in connection with the preferred embodiment thereof, it should be noted that various changes and modifications are apparent to those skilled in the art. Such changes and modifications are to be understood as included within the scope of this invention as defined by the appended claims unless they depart therefrom.

We claim:

1. A method for making a pitting resistant cast iron product, which comprises the steps of:

casting a cast iron of a composition containing 2.8 to 3.8% of C, 1.8 to 2.8% of Si, 0.5 to 1.0% of Mn, 0.2 to 1.0% of Cu, 0.2 to 1.0% of Ni, 0.5 to 1.5% of Cr, 0.4 to 1.5% of Mo, up to 0.15% of P, up to 0.1% of S and Fe being the balance, so as to form a casting having a chilled structure at that portion of the casting which serves as a sliding face, said chilled structure containing 30 to 50% of cementite precipitated therein;

annealing the resultant casting at 550° to 630° C. for 20 to 60 minutes;

machining the annealed casting;

subjecting the machined casting to a quenching treatment by heating it, to a temperature of between 850° and 950° C. for a time of from 1 to 10 minutes within the area I bounded by points A, B, C, D, E, F and G in FIG. 1, and then quenching it to produce the product having a martensite matrix with no cementite decomposed; and tempering the product at 100° to 250° C. for a predetermined time not longer than 120 minutes.

* * * * *